US006436828B1

(12) United States Patent
Chen et al.

(10) Patent No.: US 6,436,828 B1
(45) Date of Patent: Aug. 20, 2002

(54) CHEMICAL MECHANICAL POLISHING USING MAGNETIC FORCE

(75) Inventors: Hung Chih Chen, San Jose; Steven M. Zuniga, Soquel, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/565,200

(22) Filed: May 4, 2000

(51) Int. Cl.[7] ..... H01L 21/461
(52) U.S. Cl. ..... 438/691; 438/692
(58) Field of Search ..... 451/141, 285, 451/287, 289, 278, 533, 41, 259, 288, 526, 529, 539, 165, 273; 438/691, 692

(56) References Cited

U.S. PATENT DOCUMENTS

| | | | | |
|---|---|---|---|---|
| 1,665,226 A | | 4/1928 | Simmons | |
| 2,443,733 A | | 6/1948 | Karge | |
| 2,474,800 A | | 6/1949 | Nill | |
| 4,222,204 A | * | 9/1980 | Benner | 51/362 |
| 4,270,314 A | | 6/1981 | Cesna | |
| 4,873,792 A | | 10/1989 | Linke et al. | |
| 4,941,245 A | | 7/1990 | Yamashita et al. | |
| 5,205,082 A | | 4/1993 | Shendon et al. | |
| 5,357,717 A | | 10/1994 | Friel, Jr. et al. | |
| 5,398,459 A | | 3/1995 | Okumura et al. | |
| 5,441,444 A | | 8/1995 | Nakajima | |
| 5,443,416 A | | 8/1995 | Volodarsky et al. | |
| 5,498,199 A | | 3/1996 | Karlsrud et al. | |
| 5,624,299 A | | 4/1997 | Shendon | |
| 5,643,053 A | | 7/1997 | Shendon | |
| 5,681,215 A | | 10/1997 | Sherwood et al. | |
| 5,732,938 A | | 3/1998 | Rajanathan et al. | |
| 5,828,224 A | | 10/1998 | Maruyama | |
| 5,940,956 A | | 8/1999 | Jordan | |
| 5,989,103 A | | 11/1999 | Birang et al. | |
| 6,019,671 A | * | 2/2000 | Shendon | 451/56 |
| 6,036,587 A | * | 4/2000 | Tolles et al. | 451/288 |
| 6,059,638 A | * | 5/2000 | Crevasse et al. | 451/141 |
| 6,121,142 A | * | 9/2000 | Crevasse et al. | 438/691 |
| 6,121,143 A | * | 9/2000 | Messner et al. | 438/692 |
| 6,183,352 B1 | | 2/2001 | Kurisawa | |
| 6,188,544 B1 | * | 2/2001 | Mino | 360/126 |
| 6,220,945 B1 | | 4/2001 | Hirokawa et al. | |

FOREIGN PATENT DOCUMENTS

| | | |
|---|---|---|
| DE | 41 19 752 | 12/1992 |
| DE | 42 00 365 | 7/1993 |
| DE | 44 44 496 | 6/1996 |
| EP | 0 786 310 | 7/1997 |
| JP | 63-312037 | 12/1988 |
| JP | 4-10553 | 1/1992 |

* cited by examiner

*Primary Examiner*—Caridad Everhart
*Assistant Examiner*—V. Yevsikov
(74) *Attorney, Agent, or Firm*—Fish & Richardson

(57) ABSTRACT

A chemical mechanical polishing apparatus includes a carrier head, a platen positioned on an opposing side of the carrier head, and a polishing pad positioned on the platen to contact and polish the substrate received on the substrate receiving surface. The carrier head includes a housing, a flexible membrane attached to the housing and having a substrate receiving surface to receive a substrate. The flexible membrane has magnetically sensitive particles distributed therein. One or more coils are positioned above the flexible membrane to generate magnetic fields to exert magnetic forces on the particles.

16 Claims, 3 Drawing Sheets

CHEMICAL MECHANICAL POLISHING USING MAGNETIC FORCE

BACKGROUND

The present invention relates generally to chemical mechanical polishing of substrates, and more particularly to a carrier head to hold a substrate during chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a polishing surface, e.g., a rotating polishing pad or moving polishing belt. The polishing pad may be either a "standard" or a fixed-abrasive pad. A standard polishing pad has a durable roughened surface, whereas a fixed-abrasive pad has abrasive particles held in a containment media. A polishing slurry, including at least one chemically-reactive agent, and abrasive particles, if a standard pad is used, is supplied to the surface of the polishing pad. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate.

The effectiveness of a CMP process may be measured by its polishing rate (removal rate), and by the resulting finish (absence of small-scale roughness) and flatness (absence of large-scale topography) of the substrate surface. The removal rate, finish and flatness are determined by the pad and slurry combination, the relative speed between the substrate and pad, and the force pressing the substrate against the pad.

The removal rate is determined by many factors, including the downward force pressing the substrate against the polishing pad. However, a uniform removal rate across the substrate does not necessarily result even if the downward force is applied uniformly. For example, one problem in CMP is the "center slow effect," which results in underpolishing of a central portion of the substrate. Such an effect is typically associated with the substrates having tungsten and aluminum layers. Another problem is the "center fast effect," which results in overpolishing of a central portion of the substrate. Such an effect is typically associated with the substrates having copper layers.

SUMMARY

In one aspect, the invention is directed to a carrier head with a housing, a flexible membrane coupled to the housing, and one or more coils positioned above the flexible membrane. The flexible membrane has a substrate receiving surface to receive a substrate, and has magnetically sensitive particles distributed therein. The coils o generate magnetic fields to exert magnetic forces on the particles.

Implementations of the invention may include one or more of the following features. The flexible membrane and housing may define a pressurizable chamber to press the substrate against the polishing pad. Three coils may be positioned concentrically about an axis of rotation of the carrier head. The current passing through each of the three coils can be independently controlled. The magnetically sensitive particles may include iron.

In another aspect, the invention is directed to a chemical mechanical polishing apparatus. The apparatus has a carrier head, a polishing surface, and one or more coils. The carrier head has a housing and a flexible membrane with magnetically sensitive particles distributed therein. The membrane is coupled to the housing and has a substrate receiving surface to receive a substrate. The polishing surface contacts and polishes the substrate received on the substrate receiving surface. The coils are positioned on a side of the polishing surface opposite the substrate to generate magnetic fields to exert magnetic forces on the particles.

Implementations of the invention may include one or more of the following features. A platen may support the polishing surface and the coils. The plurality of coils may be positioned concentrically about an axis of rotation of the platen.

In another aspect, the invention is directed to a chemical mechanical polishing apparatus that includes a carrier head, a polishing surface, and one or more coils. The carrier head includes a housing, a flexible membrane coupled to the housing and having a substrate receiving surface to receive a substrate. The flexible membrane has magnetically sensitive particles distributed therein. The polishing surface is positioned to contact and polish the substrate received on the substrate receiving surface. The coils generate magnetic fields to exert magnetic forces on the particles in the membrane and affect a pressure on the substrate.

Implementations of the invention may include one or more of the following features. The coils may be are positioned on a side of the polishing surface opposite the substrate. A platen may support the polishing surface and the coils. The coils may be positioned in the carrier head. A plurality of voltage sources may each be coupled to one of a plurality of coils to independently control voltages applied to each of the coils. Current may flow through the coils in opposite directions. The magnetically sensitive particles may include iron. The magnetically sensitive particles may be distributed non-uniformly in the membrane.

In another aspect, the invention is directed to a method of polishing a substrate in which a substrate held by a carrier head is brought into contact with a polishing surface, relative motion is created between the polishing surface and the substrate, and magnetic fields are generated to control the pressure being applied to different portions of the substrate.

Implementations of the invention may include one or more of the following features. The carrier head may a flexible membrane with magnetically sensitive particles dispersed therein, and the magnetic fields may create magnetic forces on the particles. The flexible membrane may define a chamber, and wherein the chamber may be pressurized to apply a load to the substrate. A portion of the load being applied to the substrate may be cancelled or supplemented with the force exerted on the particles. The coils may be located in the carrier head or on a side of the polishing surface opposite the substrate. Each of the coils may be coupled to an independent voltage source to independently control voltages being applied to each of the coils.

Implementations of the invention may potentially include zero or more of the following advantages. The pressure applied to the substrate can be controlled without requiring complex pneumatics. Non-uniform pressures can be applied to the substrate to compensate for non-uniform polishing rates. The invention provides an increased removal-rate profile control, e.g., to compensate for the center fast effect and the center slow effect.

Other features and advantages of the invention will be apparent from the following description, including the drawings and claims.

BRIEF DESCRIPTION OF THE DRAWINGS

FIG. 4 shows graphs of how the removal rates across the substrate are affected when the coils in the carrier head of FIG. 2 are turned on.

DETAILED DESCRIPTION

Figure 1:
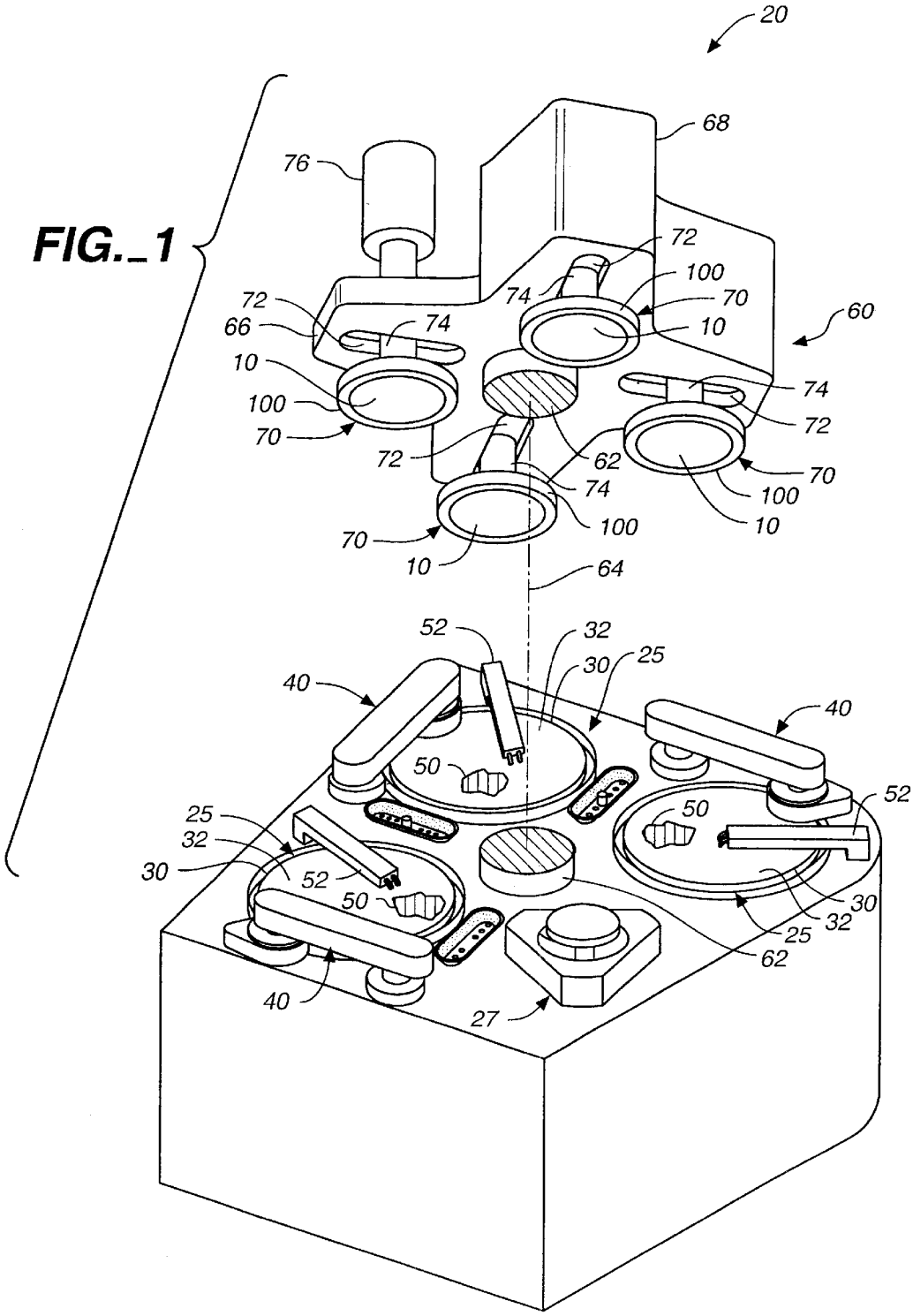
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a series of polishing stations 25 and a transfer station 27 for the loading and unloading of the substrates. Each polishing station 25 includes a rotatable platen 30 on which is placed a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 and polishing pad 32 may also be about twenty inches in diameter if substrate 10 is a six-inch (150 millimeter) diameter disk. In the exemplary embodiment provided below, the dimensions of components provided are for those configured to handle the eight-inch disk or substrate. For most polishing processes, a platen drive motor (not shown) rotates platen 30 at thirty to two-hundred revolutions per minute, although lower or higher rotational speeds may be used. Each polishing station 25 may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60 is supported by a center post 62 and rotated thereon about a carousel axis 64 by a carousel motor assembly (not shown). Multi-head carousel 60 includes four carrier head systems 70 mounted on a carousel support plate 66 at equal angular intervals about carousel axis 64. Three of the carrier head systems position substrates over the polishing stations. One of the carrier head systems receives a substrate from and delivers the substrate to the transfer station. The carousel motor may orbit carrier head systems 70, and the substrates attached thereto, about carousel axis 64 between the polishing stations and the transfer station.

Each carrier head system 70 includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of a carousel cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads, are positioned at and above the three polishing stations. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
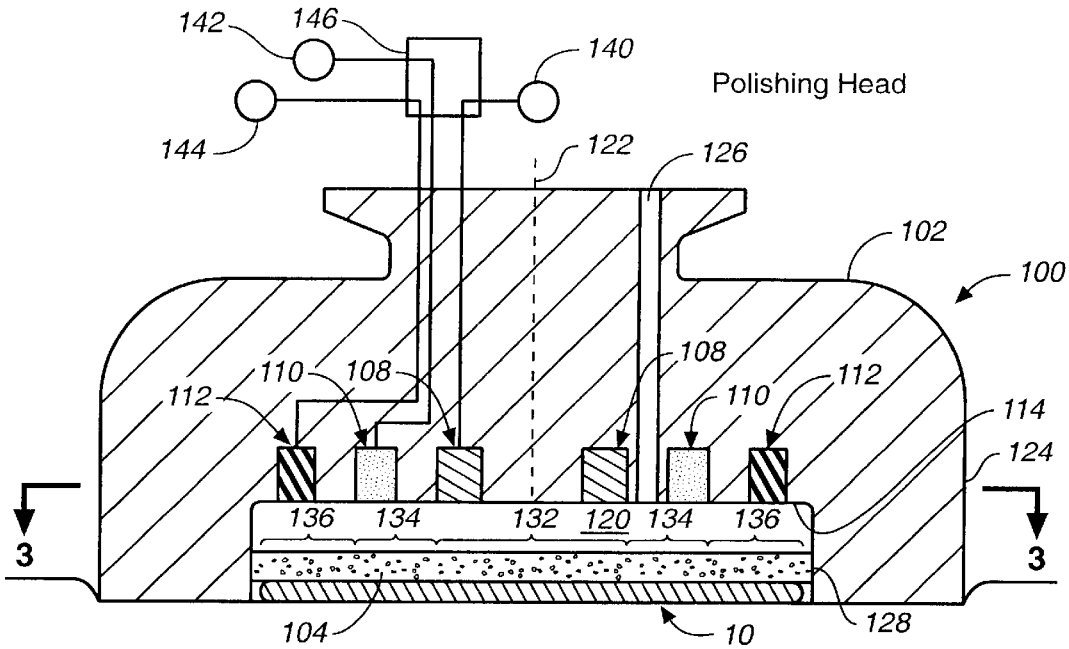
FIG. 2 is a schematic cross-sectional view of a carrier head according to the present invention.

Referring to FIG. 2, carrier head 100 includes a housing 102, a flexible membrane 104 secured to the housing, and a plurality of coils, e.g., a first coil 108, a second coil 110 and a third coil 112, placed in the housing, immediately above an underside 114 of the housing. Substrate 10 is attached to a substrate receiving surface 116 on the membrane.

Housing 102 can be connected to drive shaft 74 to rotate therewith during polishing about an axis of rotation which is substantially perpendicular to the surface of the polishing pad during polishing. Housing 102 may be generally circular in shape to correspond to the circular configuration of the substrate to be polished. An outer portion of housing 102 may serve as a retaining ring 124. A vertical passage 126 may be formed through the housing to provide pneumatic control of the carrier head. Unillustrated O-rings may be used to form a fluid-tight seal between the passage through the housing and a corresponding passage through the drive shaft.

Membrane 104 is a generally circular sheet formed of a flexible and elastic material, such as silicone. The membrane includes therein uniformly distributed magnetically sensitive particles 118, which cooperate with coils 108, 110 and 112 to control the force being applied to the substrate, as explained in greater detail below. Magnetically sensitive particles 118 refer to particles that are attracted or repulsed by the magnetic fields, such as iron, hematite and magnetite. Particles 118 may be distributed non-uniformly in the membrane, i.e., some regions having higher or lower concentration of the particles than others. With a non-uniform distribution of particles, a uniform magnetic field applied to the membrane will create a non-uniform pressure on the substrate. By selecting the distribution of particle, the non-uniform pressure can compensate for non-uniform polishing rates on the substrate.

The edges 128 of membrane 104 can be secured to housing 102 to form a fluid-tight seal, e.g., by an unillustrated clamp, adhesive, or the like. The sealed volume between membrane 104 and housing 102 defines a loading chamber 120. Loading chamber 120 can be pressurized to apply a chamber load, i.e., a downward pressure, to membrane 104 and thus to the substrate. A pump (not shown) may be fluidly connected to loading chamber 120 by passage 126 to control the pressure in the loading chamber and, thus, the load applied to the substrate. Chamber 120 is a unitary volume and provides a uniform pressure to the substrate.

As explained previously, the removal rate may vary across the substrate even if the chamber load exerts a uniform pressure. This non-uniformity may be prevented by selectively applying varying pressures across the substrate, e.g., applying more pressure on the regions that tend to be underpolished and less pressure on the regions that tend to be overpolished. This may be done by combining the chamber load with magnetic force generated by the coils, as explained in greater detail below with reference to FIG. 4.

Figure 3:
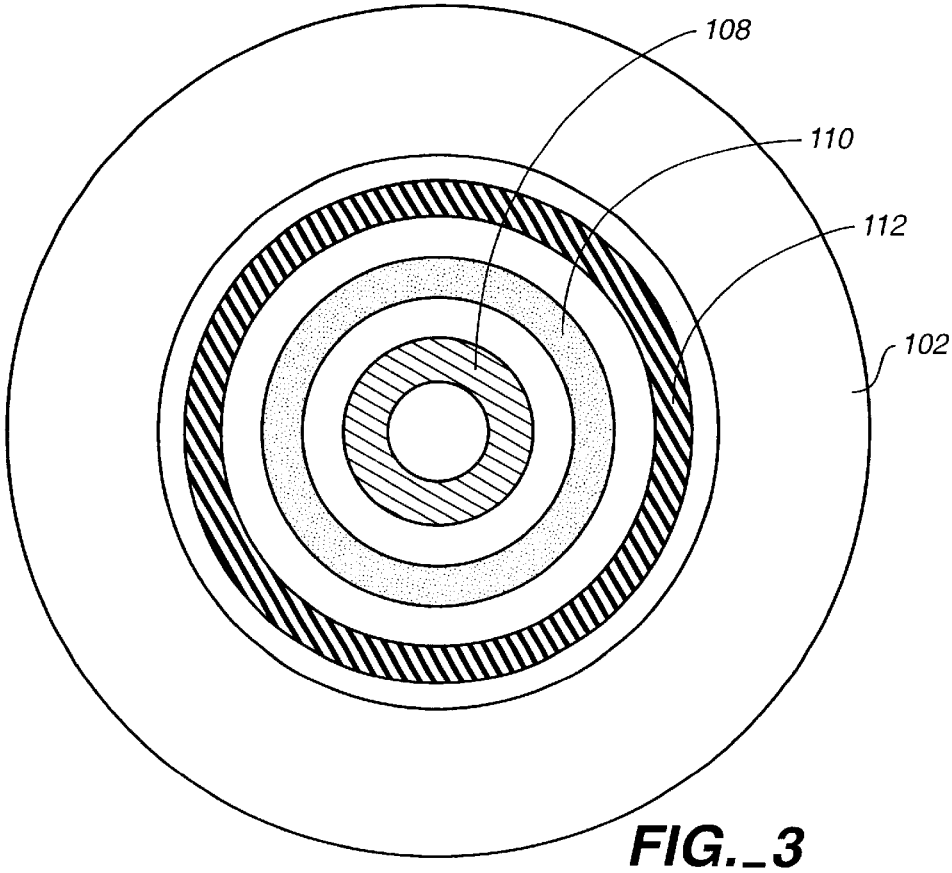
FIG. 3 is a cross-sectional view of the carrier head of FIG. 2 along line 3—3.

Referring to FIGS. 2 and 3, first, second and third coils 108, 110 and 112 are positioned concentrically about a carrier head axis 122 of carrier head 100. The coils are placed within the housing and immediately above an underside 114 of the housing. Alternatively, the coils may be positioned on underside 114 or any location which is sufficiently in close proximity to membrane 104. First coil 108, second coil 110 and third coil 112 may be spaced at regular intervals (e.g., about ⅓ of the carrier head radius) from the central axis. The portions of membrane 116 directly below the first coil, the second coil and the third coil define a central membrane portion 132, an intermediate membrane portion 134, and an outer membrane portion 136, respectively. Central membrane portion 132, intermediate membrane portion 134 and outer membrane portion 136 exert pressure on corresponding portions of substrate 10.

Alternatively, more than or less than three coils may be used to control the removal rate profile. For example, only one coil may be placed above the central membrane portion to control the polishing profile at the central substrate portion. Alternatively, one coil may be placed above the outer membrane portion to control the polishing profile at the outer substrate portion.

First, second and third coils 108, 110 and 112 are coupled independently through a rotatary coupling 146 to first, second and third voltage sources 140, 142 and 144, respectively. The voltage sources are independently controlled, so that the application of voltages to each of the coils may be independently controlled. The amount of voltage applied to the coil determines the amount of electrical current flowing through the coil, and the intensity of the magnetic field is proportional to the current flowing in the coil.

The current flow in the coil generates a magnetic field that is generally orthogonal to the current flow in the region of the flexible membrane. It should be noted that due to the circulating nature of the magnetic field, it may create a primary field region oriented in a first direction in a first region of the flexible membrane directly beneath the coil, and a secondary field region oriented generally opposite to the first direction in a second region of the flexible membrane surrounding the first region. However, it should be possible to reduce or eliminate the effects of the secondary field regions through proper selection of the current flowing through the coils.

Assuming that the magnetic particles 118 are not diamagnetic, the magnetic field exerts an upward force on particles 118 in the membrane. The force exerted on particles 118 increases as the magnetic field intensity increases. Therefore, the magnetic force exerted on particles 118 may be controlled by controlling the voltages applied to the coils.

Activation of third coil 112 will apply the primary magnetic field to at least the central, intermediate and outer membrane portions 132, 134 and 136. Activation of second coil 110 will apply the primary magnetic field to the central and intermediate membrane portions 132 and 134. Activation of first coil 108 will apply the primary magnetic field to the central membrane portion 132. By running current in the coils in the same direction, it is possible to apply a greater magnetic field to an inner portion of the membrane than an outer portion of the membrane. In contrast, by running current in the coils in opposite directions, it is possible to apply a greater magnetic field to an outer portion of the membrane than an inner portion of the membrane. For example, to apply a magnetic field only to outer membrane portion 134, the current in second coil 110 and third coil 112 current can pass through the coils in opposite directions. The magnetic field generated by the second coil 110 would partially or substantially cancel the magnetic field generated by third coil 112 at the inner and intermediate portions of the membrane, but could actually amplify the magnetic fields at the outer portion of the membrane. It should be noted that the magnetic effects from the secondary field regions generated by an inner coil, e.g., the first coil 108, can be reduced, cancelled or supplemented by an outer coil that surrounds the inner coil, e.g., the second coil 110.

Figure 4:
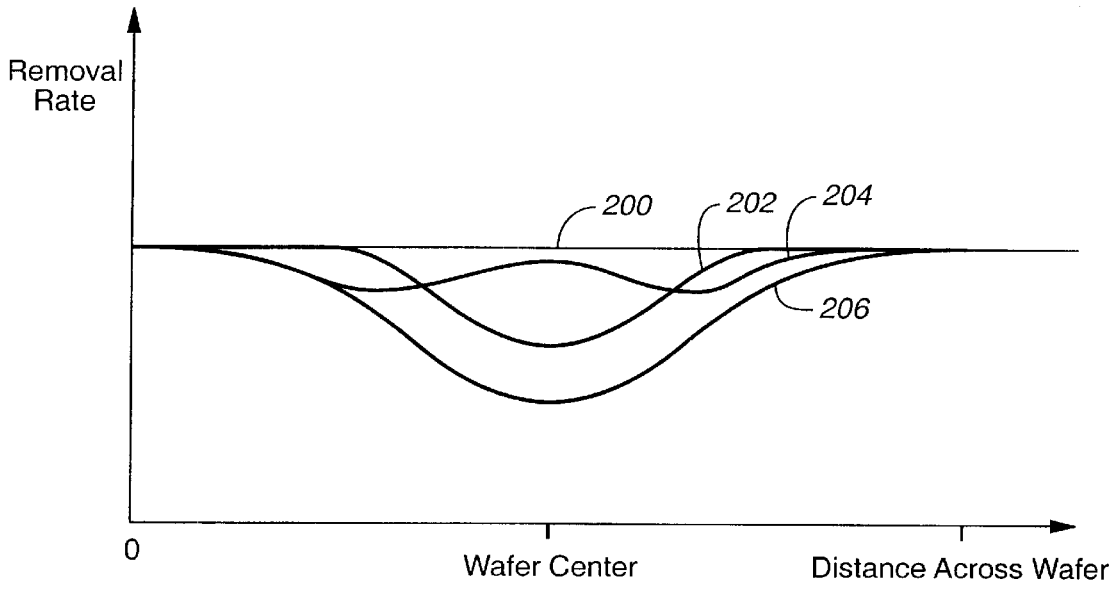

Referring to FIG. 4, a greater or less force may be applied to different regions of the substrate to obtain a more uniform polishing profile across the substrate. For example, less force could be applied to the central portion of the substrate to decrease the polishing rate and offset the center fast effect. Alternatively, less force could be applied to the intermediate and outer portions of the substrate so that the center portion experiences relatively faster polishing rate to offset the center slow effect.

The substrate may be pressed against the polishing pad with different forces at different regions by combining the chamber load and the magnetic force. The chamber load, generally used as a primary load, provides a uniform force across the substrate, as shown by a graph 200. The magnetic fields generated around the coils, generally used as a secondary load, may be used to negate or amplify the pressure applied to the selected regions of the substrate, as shown by graphs 202, 204 and 206.

Referring to graph 202, first coil 108 may be turned on to compensate the center fast effect. Graph 202 shows the removal rate across the substrate if first coil 108 is excited while other two coils are turned off. The current flow in the first coil generates magnetic fields around the first coil in orthogonal direction to the current flow. The magnetic field exerts an upward force on particles 118. The particles in the central membrane portion experience the greatest upward force. The downward force exerted by the chamber load on the central substrate portion via membrane 116 is partly negated by the upward force exerted on the particles of membrane 116 by the magnetic force. Consequently, the central substrate portion receives a less load than other parts of the substrate, decreasing the removal rate at the central substrate portion and offsetting the center fast effect associated with the copper substrates.

Second and third coils 110 and 112 may be used to control the removal rate profile at the intermediate and outer portions of the substrate. For example, the sharp removal rate variances between central substrate portion 138 and other substrate portions 140 and 142 may be reduced by controlling the voltages applied to the second and third coils.

Referring to graph 204, coils 108 and 112 may be excited to compensate for the center slow effect. Graph 204 shows the removal rate across the substrate when current flows through first coil 108 and third coil 110 in opposite directions. As discussed above, the magnetic field generated by the first coil 108 partially negates the magnetic field generated by third coil 110. As a result, the magnetic fields generated in the center portion of the membrane are less intense than those generated in the intermediate and outer portions of the membrane. Consequently, the upward force exerted on the center portion is less than the upward force exerted on the intermediate and outer membrane portions.

Graph 206 shows the removal rate across the substrate when current flows through coils 108, 110 and 112 in the same direction. The magnetic field increases inwardly from the third coil to the second coil to the first coil. Therefore, the removal rate progressively decreases from the outer substrate portion, the intermediate substrate portion and the central substrate portion.

Figure 5:
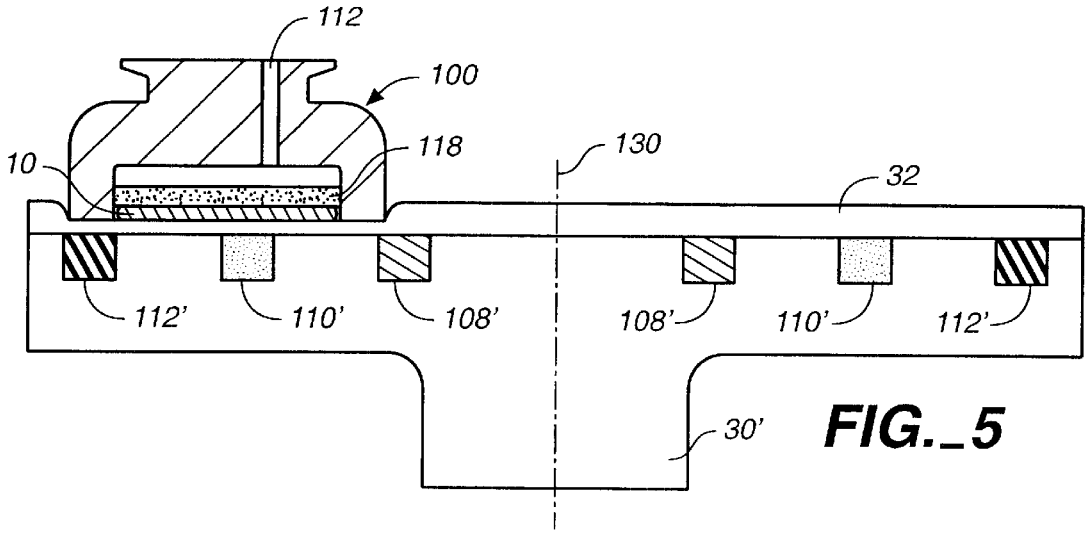
FIG. 5 is a cross-sectional view of a platen having a plurality of coils and of a carrier head.

Referring to FIG. 5, in another embodiment, first, second and third coils 108', 110' and 112' are provided under a polishing pad 32' and within a platen 30'. The coils are arranged concentrically about a platen axis 130. First, second and third coils 108', 110' and 112' are coupled to first, second and third voltage sources 124', 126' and 128' (not shown), respectively. The first and third coils generally remain under the outer substrate portion during the polishing operation. The second coil generally remains under the central substrate portion during the polishing operation. The carrier head holding the substrate may oscillate one to two inches along a radial direction of the platen. Alternatively, the carrier head may be held at a fixed radial position relative to the platen. By exiting coils 108', 110' and 112', the magnetic field can be generated which exert a downward force on particles 118 in the membrane. This downward force is added to the chamber load resulting from the pressurization of the chamber 120.

In another embodiment, the coils may be provided in both the carrier head and the platen to provide a greater removal-rate profile control.

The present invention has been described in terms of a number of embodiments. The invention, however, is not limited to the embodiments depicted and described. Rather, the scope of the invention is defined by the appended claims.

What is claimed is:

1. A carrier head comprising:

a housing;

a flexible membrane coupled to the housing and having a substrate receiving surface to receive a substrate, the flexible membrane having magnetically sensitive particles distributed therein;

a pressurizable chamber defined by the flexible membrane and the housing to apply pressure to the substrate; and one or more coils positioned above the flexible membrane to generate magnetic fields to exert magnetic forces on the particles.

2. The carrier head of claim 1, three coils are positioned concentrically about an axis of rotation of the carrier head.

3. The carrier head of claim 2, wherein the current passing through each of the three coils can be independently controlled.

4. The carrier head of claim 1, wherein the magnetically sensitive particles include iron.

5. A chemical mechanical polishing apparatus, comprising:

a carrier head including a housing, a flexible membrane coupled to the housing and having a substrate receiving surface to receive a substrate, the flexible membrane having magnetically sensitive particles distributed therein, and a pressurizable chamber defined by the flexible membrane and the housing to apply pressure to the substrate;

a polishing surface positioned to contact and polish the substrate received on the substrate receiving surface; and one or more coils positioned on a side of the polishing surface opposite the substrate to generate magnetic fields to exert magnetic forces on the particles.

6. The apparatus of claim 5, further comprising a platen supporting the polishing surface and the coils.

7. The apparatus of claim 5, wherein a plurality of coils are positioned concentrically about an axis of rotation of the platen.

8. A chemical mechanical polishing apparatus, comprising:

a carrier head including a housing, a flexible membrane coupled to the housing and having a substrate receiving surface to receive a substrate, the flexible membrane having magnetically sensitive particles distributed therein, and a pressurizable chamber defined by the flexible membrane and the housing to apply pressure to the substrate;

a polishing surface positioned to contact and polish the substrate received on the substrate receiving surface; and one or more coils to generate magnetic fields to exert magnetic forces on the particles in the membrane and affect a pressure on the substrate.

9. The apparatus of claim 8, wherein the coils are positioned on a side of the polishing surface opposite the substrate.

10. The apparatus of claim 9, further comprising a platen to support the polishing surface and the coils.

11. The apparatus of claim 8, wherein the coils are positioned in the carrier head.

12. The apparatus of claim 8, wherein the one or more coils include a plurality of concentric coils.

13. The apparatus of claim 12, further including a plurality of voltage sources, each coupled to one of the plurality of coils to independently control voltages applied to each of the coils.

14. The apparatus of claim 8, wherein a first coil of the plurality of coils is energized with current flowing in an opposite direction as current in a second coil of the plurality of coils.

15. The apparatus of claim 8, wherein the magnetically sensitive particles include iron.

16. The apparatus of claim 8, wherein the magnetically sensitive particles are distributed non-uniformly in the membrane.

* * * * *